United States Patent [19]

Anderson, III

[11] Patent Number: 5,019,801

[45] Date of Patent: May 28, 1991

[54] ARTICLE SURVEILLANCE SYSTEM HAVING TARGET REMOVAL SENSOR

[75] Inventor: Philip M. Anderson, III, Madison, N.J.

[73] Assignee: Identitech, Essex, N.J.

[21] Appl. No.: 463,771

[22] Filed: Jan. 4, 1990

Related U.S. Application Data

[63] Continuation of Ser. No. 384,841, Jul. 24, 1989, abandoned, which is a continuation of Ser. No. 102,974, Sep. 30, 1987, abandoned.

[51] Int. Cl.[5] ..... G08B 19/00; G08B 13/14

[52] U.S. Cl. ..... 340/522; 340/571; 340/572; 340/573; 40/299; 40/625

[58] Field of Search ..... 340/522, 551, 571–573, 340/518; 40/2 R, 2 A, 625, 628, 299, 300, 647

[56] References Cited

U.S. PATENT DOCUMENTS

| | | | |
|---|---|---|---|
| 3,938,044 | 2/1976 | Lichtblau | 340/572 |
| 4,685,234 | 8/1987 | Anderson et al. | 340/572 |
| 4,728,938 | 3/1988 | Kaltner | 340/527 |
| 4,742,341 | 5/1988 | Hogen Esch | 340/572 |
| 4,751,500 | 6/1988 | Minasy et al. | 340/572 |

*Primary Examiner*—Donnie L. Crosland

*Attorney, Agent, or Firm*—Robin, Blecker, Daley & Driscoll

[57] ABSTRACT

An article surveillance marker includes a marker body having two sections connected together by a resilient hinge. A securing pin holds the body sections together in a closed position and secures the marker to an article to be protected. Two ferromagnetic ribbons are housed within separate cavities in the marker body. The first ribbon is free to mechanically vibrate and produce a first signal in response to an applied interrogation field that indicates the conveyance of the protected article from an authorized area. A contact button on the marker body damps and deactivates the second ribbon when the marker body sections are closed and the marker is secured to the article. Specifically, the contact button extends through an aperture in the marker body that communicates with the cavity containing the second marker ribbon. When the marker is closed, the button engages the second ribbon and prevents mechanical vibration and, therefore, the production of a second response signal. Conversely, when the marker is opened, the contact button disengages the second ribbon that is then free to vibrate mechanically and produce a signal indicating the unauthorized opening and removal of the marker from the article. A complete article surveillance system including a marker and two interrogation and detection circuits is also provided.

16 Claims, 2 Drawing Sheets

ARTICLE SURVEILLANCE SYSTEM HAVING TARGET REMOVAL SENSOR

This application is a continuation of application Ser. No. 384,841, filed July 24, 1989, now abandoned, which is a continuation of application Ser. No. 102,974, filed Sept. 30, 1987, now abandoned.

TECHNICAL FIELD

This invention relates to article surveillance systems and markers for use therein. More particularly, the invention provides a marker that indicates unauthorized opening and removal of the marker from an article appointed for protection.

BACKGROUND OF THE INVENTION

Theft of clothing and other soft goods articles from retail stores is a very serious problem. The cost of replacing the stolen articles annually runs in the billions of dollars and is increasing.

Advanced electronic systems employed to prevent theft of clothing articles generally comprise a marker element secured to the article and an electronic interrogator adapted to detect a signal produced by marker, An example of such a system may be found in U.S. Pat. No. 4,510,489 to Anderson, III, et al., owned by the assignee of the present invention and incorporated herein by reference. Typically, the interrogator includes a transmitting apparatus, including a drive coil, situated on one side of a passage leading a store exit and a receive coil for detecting the response signal from the marker at the other side of the passage. The drive coil produces an interrogation signal that energizes the marker, When energy marker produces an identifiable response is by the receive coil. Detection of the presence of the response signal indicates that the article has not been properly checked out by the cashier and may, in fact, be stolen.

One of the major considerations with such theft detection systems is the manner of fastening to the clothing or similar articles. A number of structures have been developed to securely fix the markers to the article and prevent unauthorized removal of the markers by shoplifters. It must be recognized, however, that the markers must also be easy to remove by authorized personnel, such as a cashier, following purchase of the article by a customer. It is because of this latter consideration that a completely acceptable marker construction resistant to unauthorized removal has not heretofore been developed in the art. While the markers are generally too difficult to remove from the article in the open, shoplifters in the past have been successful in taking the article to, for example, a fitting room where they can use tools to remove the article without being observed.

The present invention addresses this problem by providing an advanced electronic system including a lightweight, compact marker adapted to generate a response signal when the marker body is opened to remove the marker from an article.

SUMMARY OF THE INVENTION

Accordingly, it is a primary object of the present invention to provide an improved marker capable of signaling the unauthorized removal of the marker from an article to be protected.

Another object of the present invention is to provide a compact, lightweight dual function marker of simple construction capable of generating a signal when removed from an article or removed from an authorized area.

A further object of the present invention is to provide an advanced detection system capable of detecting the unauthorized removal of a marker from an article by producing an interrogation field in an unauthorized marker removal area, generating a response signal to the interrogation field when a marker is opened for removal from an article and detecting the response signal.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects and in accordance with the purposes of the present invention as described herein, an improved article surveillance marker is provided for indicating the unauthorized opening of a marker for removal from an article. The article surveillance marker includes a marker body having two sections connected together by means of a hinge. A securing pin is provided to hold the body sections together in a closed position and secure the surveillance marker to an article.

A first ferromagnetic ribbon is provided for generating a first response signal to an applied interrogation field. The first response signal when detected indicates the conveyance of the article from an authorized area, such as from the store premises. This ribbon serves as the primary theft detection signal source. A second ferromagnetic ribbon is provided for generating a second response signal at a different frequency than the first response signal, and once generated, indicates the unauthorized removal of the surveillance marker from the article. Preferably, the first and second ferromagnetic ribbons are both constructed of amorphous magnetostrictive material. Such ribbons produce a strong signal to noise ratio and have excellent signal identity. As more fully disclosed in the 4,510,489 patent discussed above, such magnetostrictive ribbons have the capability to resonate mechanically at a preselected frequency in response to an applied electromagnetic interrogation field.

A contact button built into the marker body damps and thereby deactivates the second ferromagnetic ribbon when the surveillance marker body sections are closed and the marker is properly and securely attached to the article to be protected. The contact button projects from an interior face of one of the marker sections and extends through an aperture in the interior face of the other marker section to engage the ribbon within a ribbon cavity in that section. Specifically, the contact button presses the second ribbon against the cavity wall and prevents mechanical vibration and, therefore, the generation of a response signal when the body sections of the marker are closed together.

In order to insure positive engagement and pressure, the contact button is positioned adjacent the hinge between the marker sections. Additionally, the marker section to which the button is connected is resiliently flexible to provide positive biasing pressure between the contact button, the second marker ribbon and the cavity wall when the marker sections are closed.

The hinge between the two marker sections is preferably a living hinge (prestressed plastic connection). When the securing pin is withdrawn from the marker body as, for example, during unauthorized removal of a marker from an article, the hinge causes the marker sections to spring apart and open, thereby relieving the damping of the second ribbon. The second ribbon is then free to mechanically vibrate in response to an applied interrogation field and produce a response signal that is detected to indicate the unauthorized opening and removal of the marker from the protected article.

In accordance with a further aspect of the present invention, an article surveillance system is provided including a marker for attachment to an article combined with an electronic interrogation and detection system. The first circuit of the interrogation and detection system defines a first interrogation field zone for the protected article adjacent an exit from the authorized area. If a protected article is conveyed into the first interrogation field zone from the authorized area, such as a store premises, an alarm is then sounded in response to the detected signal.

The second circuit of the interrogation and detection system defines a second interrogation field zone for the protected article that is within the authorized area. For example, the second interrogation zone may be set up in a fitting room within the store premises. If an individual within the fitting room opens the marker to remove it from the article, the response signal produced by the now undamped second ribbon is detected, and an alarm is sounded.

BRIEF DESCRIPTION OF THE DRAWING

The invention will be more fully understood and further advantages will become apparent when reference is made to the following detailed description of the preferred embodiment of the invention and the accompanying drawings, in which.

DETAILED DESCRIPTION OF THE INVENTION

Reference will now be made in detail to the present preferred embodiment of the invention, an example of which is illustrated in the accompanying drawings.

Figure 1:
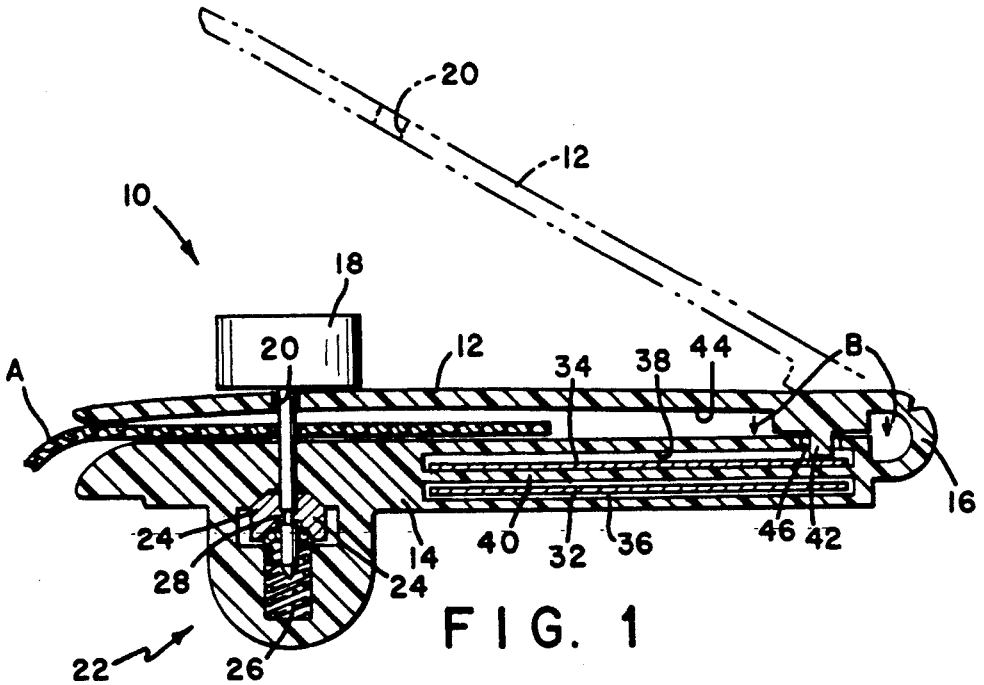
FIG. 1 is a cross-sectional view of the article surveillance marker of the present invention in the closed position and secured to an article.

Referring to FIG. 1, there is shown the article surveillance marker 10 of the present invention attached to an article of clothing A. As shown, the marker 10 includes a marker body of, for example, molded ABS plastic including an upper section 12 and a lower section 14 articulated to each other through a living (resilient) hinge 16. The marker 10 is attached to the article A by closing the upper body section 12 over the article (i.e. moving from the dashed line to the full line position). A securing pin 18 is then inserted through an aperture 20 in the upper body section 12 and through the article A so as to be received in the locking mechanism 22 housed in the lower body section 1. The locking mechanism 22 includes a pair of latching chocks 24 that are biased by a spring 26 to a closed position so as to securely clamp and retain the securing pin 18. Specifically, the internal flanges 28 on the chocks 24 engage a groove 30 in the pin 18 (see FIG. 2) to provide positive edge-to-edge locking action. A more detailed disclosure of the locking, mechanism may be found in U.S. Pat. No. 4,685,234 entitled SURVEILLANCE MARKER CLIP ASSEMBLY and incorporated herein by reference. The locking mechanism 22 described hereinabove is representative, and it will be understood by those skilled in the art that other locking mechanisms such as those taught by U.S Pat. No. 3,911,534, are suitable for use in the marker of the present invention.

Dual signal producing or generating ribbons 32, 34 are housed in the lower body section 14. These ribbons 32, 34 may be positioned in the lower body section 14 through slits (not shown) in the side of the section that are permanently sealed following insertion or by any other manner known in the art. Preferably, each ribbon 32, 34 is a strip of amorphous, magnetostrictive, ferromagnetic material adapted to be magnetically biased and, thereby, armed to resonate mechanically at a standard or known frequency to generate an identifiable signal. The magnetic biasing may be provided by a separate ferromagnetic slab or plate (not shown) of high magnetic coercivity positioned adjacent the ribbons 32, 34 or by impregnating the plastic marker body with magnetized barium ferrite. The latter alternative is discussed in detail in U.S. Pat. No. 4,727,668 entitled CODED SURVEILLANCE MARKER WITH IMPROVED BIASING and incorporated herein by reference. The first ribbon 32 is positioned in a cavity 36 in the marker section 14 in an undamped condition. The second ribbon 34 is positioned in a second cavity 38 in the marker section 14 separated from the first cavity 36 by means of the wall 40.

A contact button 42 is provided to damp and deactivate the second ribbon 34 when the surveillance marker sections 12, 14 are in the closed position and attached to the article A (see FIG. 1). As shown, the contact button 42 is positioned on the upper body section 12 adjacent the hinge 16. The button 42 projects from the interior face 44 of the body section 12 and extends through an aperture 46 in the race of the lower body section 14 so as to engage the second ribbon 34 when in the closed position.

The upper body section 12 is resiliently flexible. When the body sections 12, 14 are locked together with the securing pin 18, the upper section 12 is bowed downwardly toward the section 14 in a slight arc from the hinge 16 over the contact button 42 past the securing pin 18. The resiliency of the plastic of the upper section 12 provides positive downward pressure in the direction of action arrows B to the contact button 42 thereby assuring firm engagement of the second ribbon 34 between the button and the wall 40. Thus, with the body sections 12, 14 closed and the marker 10 attached to the article A, the second ribbon 34 is prevented from mechanical oscillation and, therefore, the generation of a response signal even when in the presence of an interrogation field. While the bow in upper Section 12 is depicted as having a downward configuration, it will be understood that the configuration of the bow can be upward, or that the upper section can be provided with a stepped configuration, to provide for proper downward pressure on contact button 42 depending on the thickness of the article to which marker 10 is attached.

Figure 2:
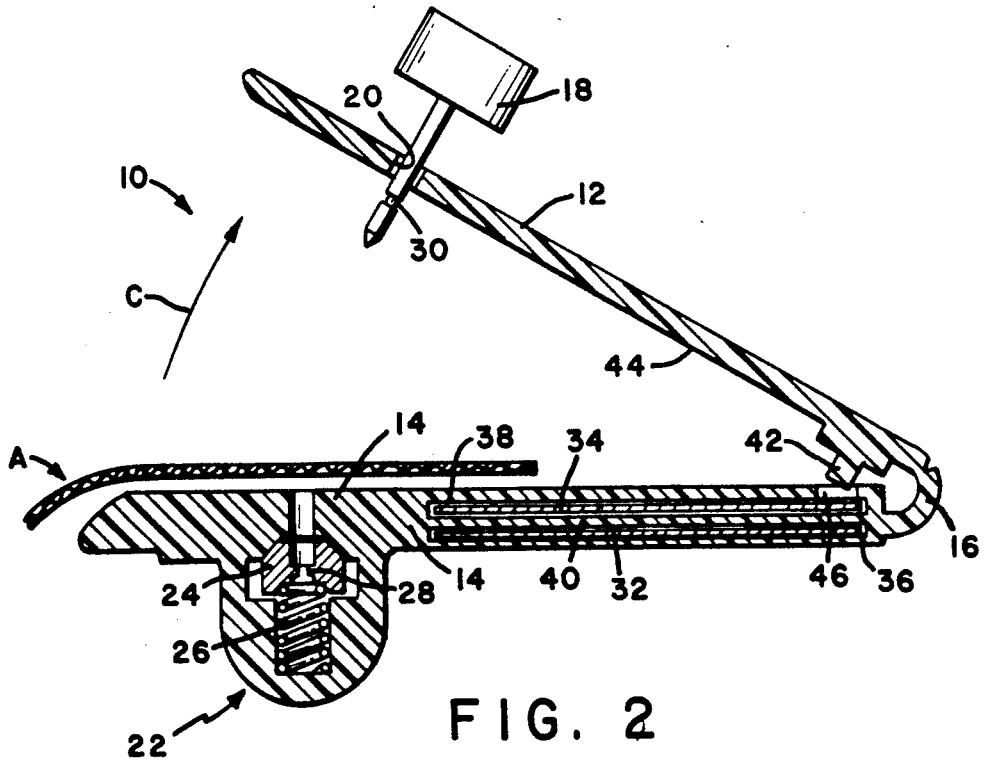
FIG. 2 is a cross-sectional view similar to FIG. 1 showing the article surveillance marker in the open position.

When the securing pin 18 is withdrawn from the lock mechanism 22 to remove the marker 10 from the Article A, the marker sections 12, 14 swing apart into the open position shown in FIG. 2. Specifically, the marker section 12 springs upward in the direction of action arrow C. The flexible and resilient body section 14 returns from the bowed orientation shown in FIG. 1 to its straight line molded position. The hinge 16 is molded so as to cause the spring bias action of the upper section 12 into the open position relative to the lower section 14 (note FIG. 2). With the movement of the upper body section 12 to the open position, the contact button 42 clearly moves, and thus releases the second ribbon 34 from engagement. The ribbon 34 is then free to mechanically oscillate in the cavity 38 and produce a signal in response to an applied interrogation field.

Thus, it can now be seen that the marker of the present invention 10 may be used as an integral part of an article surveillance system 49 for both preventing (1) the removal of an article A from an authorized area, such as a store premises, as well as (2) the removal of the marker from the article to be protected as, for example, in a fitting room F of the store premises.

Figure 3:
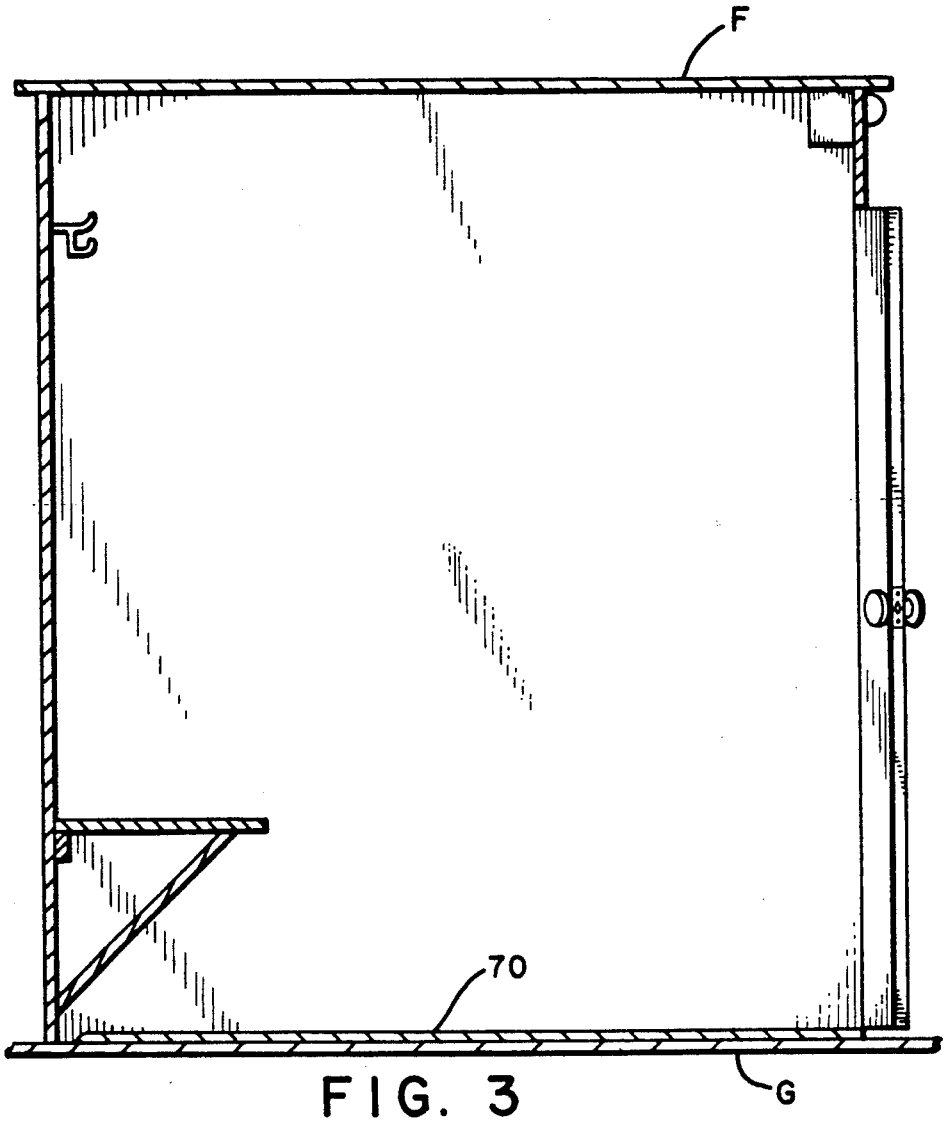
FIG. 3 is a cross-sectional schematic representation showing a fitting room equipped with the article surveillance system of the present invention.
Figure 4:
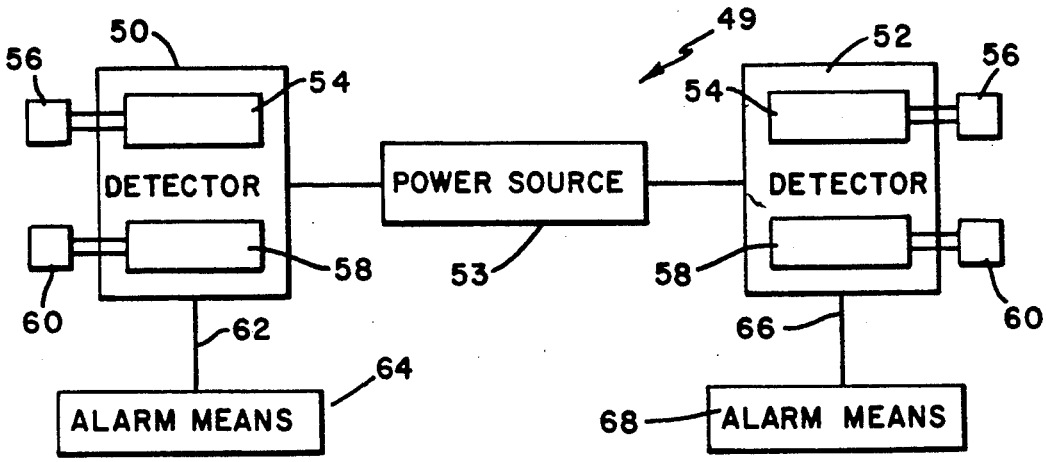
FIG. 4 is a schematic circuit diagram of the system of the present invention.

The dual surveillance system 49 includes two interrogating and detecting circuits or units 50, 52 schematically shown in FIG. 4 connected to a power source 53. The first interrogation and detection circuit 50 is positioned to define an interrogation field or zone for the marker 10 adjacent an exit from the store premises. Any marker response signal detected by this circuit 50 indicates the conveyance of a protected article through this interrogation zone from the authorized store area. The second interrogation and detection circuit 52 is positioned to define another interrogation field or zone only for open markers at some location within the store, such as the fitting room F (note FIG. 3).

As is known in the art and shown in FIG. 4, each interrogation and detection unit 50, 52 includes a transmitter 54 connected to a drive coil 56 for generating an interrogation field zone. Additionally, each interrogation and detection circuit or unit 50, 52 also includes a receiver 58 connected to a receive coil 60 for detecting signals from the surveillance markers in response to the applied interrogation field.

The receiver 58 of the first interrogation and detection response signal within the interrogation field zone at the particular frequency of the first marker ribbon 32. If such a response signal is detected, the interrogation and detection unit 50 sends a signal along line 62 to actuate an alarm 64, such as a light or buzzer indicating the unauthorized conveyance of an article from the store.

The drive and receive coils 56, 60, respectively, of the second interrogation and detection unit 52 may, for example, be fitted into a mat 70 positioned on the floor G of the fitting room F. The receiver 58 of the second interrogation and detection unit 52 is adjusted to detect a signal in response to the interrogation field at the frequency of the second ribbon 34. Upon detecting such a signal, the receiver 58 transmits a signal along line 66 to actuate the alarm 68 that indicates the unauthorized opening and removal of a marker 10.

It should be appreciated, however, that normal use of the fitting room F is in no way compromised by the utilization of the article surveillance system 49. Specifically, when the marker 10 is properly attached to the article A as shown in FIG. 1, the contact button 42 dampens and deactivates the second ribbon 34. Thus, only the first ribbon 32 is free to oscillate mechanically and produce a response signal to the interrogation field emanating from drive coil 56. The receiver 58 of the second interrogation and detection unit 52 is, however, set only to actuate the alarm upon detecting a response signal at the specific frequency of the second marker ribbon 34, not the first marker ribbon 32. Thus, it should be appreciated that a customer may use the fitting room F to try on clothing without setting off the alarm 68 as long as the marker 10 is properly attached to the clothing with the contact button 42 damping the second ribbon 34. The alarm 68 is only actuated when the marker 10 is opened as shown in FIG. 2 and the second ribbon 34 is no longer damped by the contact button 42 and, therefore, is free to oscillate mechanically and produce a response signal.

In summary, numerous benefits result from employing the concepts of the present invention. The marker 10 is both lightweight and compact. A simple contact button 42 is provided for damping and deactivating a second signal generating ribbon 34 when the marker 10 is properly closed and secured to an article A. Only upon the opening of the marker 10, for removal from the article A, is the second ribbon 34 free to oscillate mechanically and produce a response signal that indicates the unauthorized removal of the surveillance marker from the article. Proper operation of the contact button 42 is further assured by the resiliently flexible upper marker section 12 and the living hinge 16 that spring biases the upper marker section 12 to the open position shown in FIG. 2. Together, the features of the present invention provide a surveillance marker 10 and dual surveillance system 49 that is more effective and reliable in indicating the removal of a surveillance marker 10 from a protected article A.

Having thus described the invention in rather full detail it will be understood that such detail need not be strictly adhered to but that further changes and modifications may suggest themselves to one having ordinary skill in the art, all falling within the scope of the invention as defined by the subjoined claims.

I claim:

1. An article surveillance marker, comprising:

a marker body;

means for generating a first signal in response to an applied magnetic interrogation field, said first signal indicating conveyance of an article to which said surveillance marker is attached from an authorized area;

means for generating through mechanical vibration a second signal is response to an applied interrogation field, said second signal having a different frequency than said first signal, indicating unauthorized removal of the surveillance marker from the article; and means for damping the mechanical vibration of and thereby deactivating said second signal generating means when said surveillance marker is attached to the article to be protected.

2. The article surveillance marker set forth in claim 1, wherein said marker body includes two sections connected together by means of a hinge.

3. The article surveillance marker set forth in claim 2, wherein said hinge is a resilient hinge normally biasing said sections to an open position.

4. The article surveillance marker set forth in claim 2, wherein a securing pin is provided to hold said body sections together in a closed position and secure said surveillance marker to the article.

5. The surveillance marker set forth in claim 1, wherein said first response signal generating means is a magnetostrictive, ferromagnetic ribbon.

6. The article surveillance marker set forth in claim 5, wherein said magnetostrictive, ferromagnetic ribbon is composed of amorphous material.

7. The article surveillance marker set forth in claim 1, wherein said second response signal generating means is a magnetostrictive, ferromagnetic ribbon.

8. The article surveillance marker set forth in claim 7, wherein said magnetostrictive, ferromagnetic ribbon is composed of amorphous material.

9. The article surveillance marker set forth in claim 1, wherein said damping and deactivating means includes a contact button for engaging said second response signal generating means when said marker is attached to the article.

10. The article surveillance marker set forth in claim 9, wherein said contact button projects from an interior face of a marker section and extends through an aperture in an interior face of another marker section to engage said second response signal generating means contained within a cavity in said other section.

11. The article surveillance marker set forth in claim 10, herein said contact button is positioned adjacent said hinge joining said marker sections.

12. The article surveillance marker set forth in claim 11, wherein said marker section to which said contact button is connected is resiliently flexible so as to provide positive engaging pressure between said contact button and said second response signal generating means when in the closed position.

13. An article surveillance system, comprising: a marker for attachment to an article to be protected, said marker including: a marker body; means for generating a first signal in response to an applied magnetic interrogation field, said first signal indicating conveyance of an article to which said surveillance marker is attached from an authorized area; means for generating through mechanical vibration a second signal in response to an applied interrogation field, said second signal, having a different frequency than said first signal, indicating authorized removal of the surveillance marker from the article; and means for damping the mechanical vibration of and deactivating said second signal generating means when said surveillance marker is attached to the article to be protected;

first interrogating and detecting means for defining a first interrogation field zone for said protected article and for detecting said first signal as said protected article is conveyed into said first interrogation field zone from said authorized area; and second interrogating and detecting means for defining a second interrogation field zone for said protected article within said authorized area and for detecting said second signal when said marker is removed from said protected article.

14. The article surveillance system of claim 13, wherein said damping and deactivating means includes a contact button for engaging said marker response signal generating means when said marker is attached to the article.

15. The article surveillance system of claim 14, wherein said contact button projects from an interior face of a marker section and extends through an aperture in an interior face of another marker section to engage said second response signal generating means contained within a cavity in said other marker section.

16. The article surveillance system of claim 15, wherein said marker section to which said contact button is connected is resiliently flexible so as to provide positive engaging pressure between said contact button and said response signal generating means when in the closed position.

* * * * *

UNITED STATES PATENT AND TRADEMARK OFFICE

CERTIFICATE OF CORRECTION

PATENT NO. : 5,019,801

DATED : May 28, 1991

INVENTOR(S) : Philip M. Anderson, III

It is certified that error appears in the above-identified patent and that said Letters Patent is hereby corrected as shown below:

Col. 1, line 25. Change "," to -- . --

Col. 1, line 31. After "leading" insert -- to --

Col. 1, line 35. Change "," to -- . --, change "energy" to -- energized -- and insert -- the -- before "marker" second occurrence Col. 1, line 36. Change "is" to -- signal detected --

Signed and Sealed this

Twenty-seventh Day of October, 1992

*Attest:*

DOUGLAS B. COMER

*Attesting Officer*

*Acting Commissioner of Patents and Trademarks*